US009050849B2

(12) United States Patent
Hu

(10) Patent No.: US 9,050,849 B2
(45) Date of Patent: Jun. 9, 2015

(54) DOCUMENT BINDER

(71) Applicant: Wei-Cheng Hu, Taoyuan County (TW)

(72) Inventor: Wei-Cheng Hu, Taoyuan County (TW)

( * ) Notice: Subject to any disclaimer, the term of this patent is extended or adjusted under 35 U.S.C. 154(b) by 159 days.

(21) Appl. No.: 13/973,026

(22) Filed: Aug. 22, 2013

(65) Prior Publication Data

US 2015/0056000 A1 Feb. 26, 2015

(51) Int. Cl.
*B42F 13/16* (2006.01)
*B42F 13/00* (2006.01)

(52) U.S. Cl.
CPC ..... *B42F 13/16* (2013.01); *B42P 2241/00* (2013.01); *B42F 13/0073* (2013.01); *B42F 13/0066* (2013.01)

(58) Field of Classification Search
CPC ..... B42F 13/0066; B42F 13/0073
USPC ..... 402/75
See application file for complete search history.

(56) References Cited

U.S. PATENT DOCUMENTS

| | | | | |
|---|---|---|---|---|
| 2,332,547 | A * | 10/1943 | Auburn | 402/62 |
| 2005/0135873 | A1* | 6/2005 | Yeh | 402/75 |
| 2013/0136523 | A1* | 5/2013 | Conner et al. | 402/75 |

* cited by examiner

*Primary Examiner* — Kyle Grabowski
(74) *Attorney, Agent, or Firm* — Rosenberg, Klein & Lee

(57) ABSTRACT

A document binder is provided which includes a plate body including two side plates and a bridging plate connected between the two side plates, an engaging mechanism, and a fixture unit fixed to the engaging mechanism. The engaging mechanism includes a rail, two slidable shafts and at least one gear. The side plate has a coupling portion which has two protrusions. Each protrusion has an engaging slot. The two slidable shafts are slidably disposed in the rail and each slidable shaft has a pivotable portion. Each slidable shaft has a gear strip. The gear is pivotally disposed in the rail. The gear and the two gear strips are engaged. Each slidable shaft has an engaging body which is selectively coupled to the engaging slot. Thus, by pushing one end of the pivotable portion, convenient separation and combination of the fixture unit and the platy body are provided.

9 Claims, 4 Drawing Sheets

DOCUMENT BINDER

BACKGROUND OF THE INVENTION

1. Field of the Invention

The instant disclosure relates to a document binder; in particular, to a fixture unit which can disassemble the document binder from the plate body.

2. Description of Related Art

Generally, documents are stored in document binders. Different file handling requires different filing method. A conventional binder includes a plate body. The plate body is generally made of composite or plastic board. The board includes two side plates and a bridging plate connected to the side plates between the side plates. The side plates may fold and unfold corresponding to the flipping of the bridging plate. An inner surface of the side plate has a fixture unit arranged adjacent to the bridging plate. The fixture unit has a plurality of rings for punched documents to facilitate flipping.

Currently, fixture units with detachable designs are already on the market, making the fixture unit removable so that bound volumes of documents can be hanged in places such as file cabinets. Without the need of the plate body, space is saved. However, when the fixture unit is preferred to be separated or joined with the plate body, both pivotable ends need to be pushed in order to separate or join the fixture unit and the plate body, making the operations a considerable inconvenience.

To address the above issues, the inventor strives via associated experience and research to present the instant disclosure, which can effectively improve the limitation described above.

SUMMARY OF THE INVENTION

The object of the instant disclosure is to provide a document binder which can simply and conveniently operate the separation and combination of the fixture unit and the platy body by pushing one end of the pivotable portion.

In order to achieve the aforementioned objects, according to an embodiment of the instant disclosure, a document binder is provided which includes a plate body including two side plates and a bridging plate connected between the two side plates, an engaging mechanism, and a fixture unit fixed to the engaging mechanism. The engaging mechanism includes a rail, two slidable shafts and at least one gear. An inner surface of one of the side plates has a coupling portion arranged on the inner surface proximate to the bridging plate. The coupling portion has two protrusions disposed thereon, and each of the two protrusions respectively has portions defining an engaging slot thereon. The rail is removably attached to the coupling portion of the plate body. The two slidable shafts are slidably disposed in the rail and an end of each slidable shaft has a pivotable portion arranged thereon. The two pivotable portions extend out of the rail. Each slidable shaft has a gear strip. The gear is pivotally disposed in the rail. The gear and the two gear strips are engaged to each other. Each slidable shaft has an engaging body arranged thereon, and each engaging body of the slidable shaft is selectively coupled to the engaging slot of the protrusion.

The instant disclosure provides the following improvements. The linked mechanism formed by gear strips and gears is configured between the two slidable shafts of the engaging structure. Users only need to push one pivotable portion such that one slidable shaft displaces, and in turn the two slidable shafts displace via the linked mechanism. As a result, the engaging bodies of the two slidable shafts can be engaged or disengaged to the engaging slots of the two protrusions, and can assemble or disassemble the fixture unit and plate body with relatively simple and convenient operation.

Moreover, the engagement between the engaging bodies of the two slidable shafts and the engaging slots of the two protrusions facilitates the engaging structure and the fixture unit to be stably fixed onto the plate body and lowers the chance of loosen or falling parts.

In order to further understand the instant disclosure, the following embodiments and illustrations are provided. However, the detailed description and drawings are merely illustrative of the disclosure, rather than limiting the scope being defined by the appended claims and equivalents thereof.

DETAILED DESCRIPTION OF THE PREFERRED EMBODIMENTS

Figure 1:
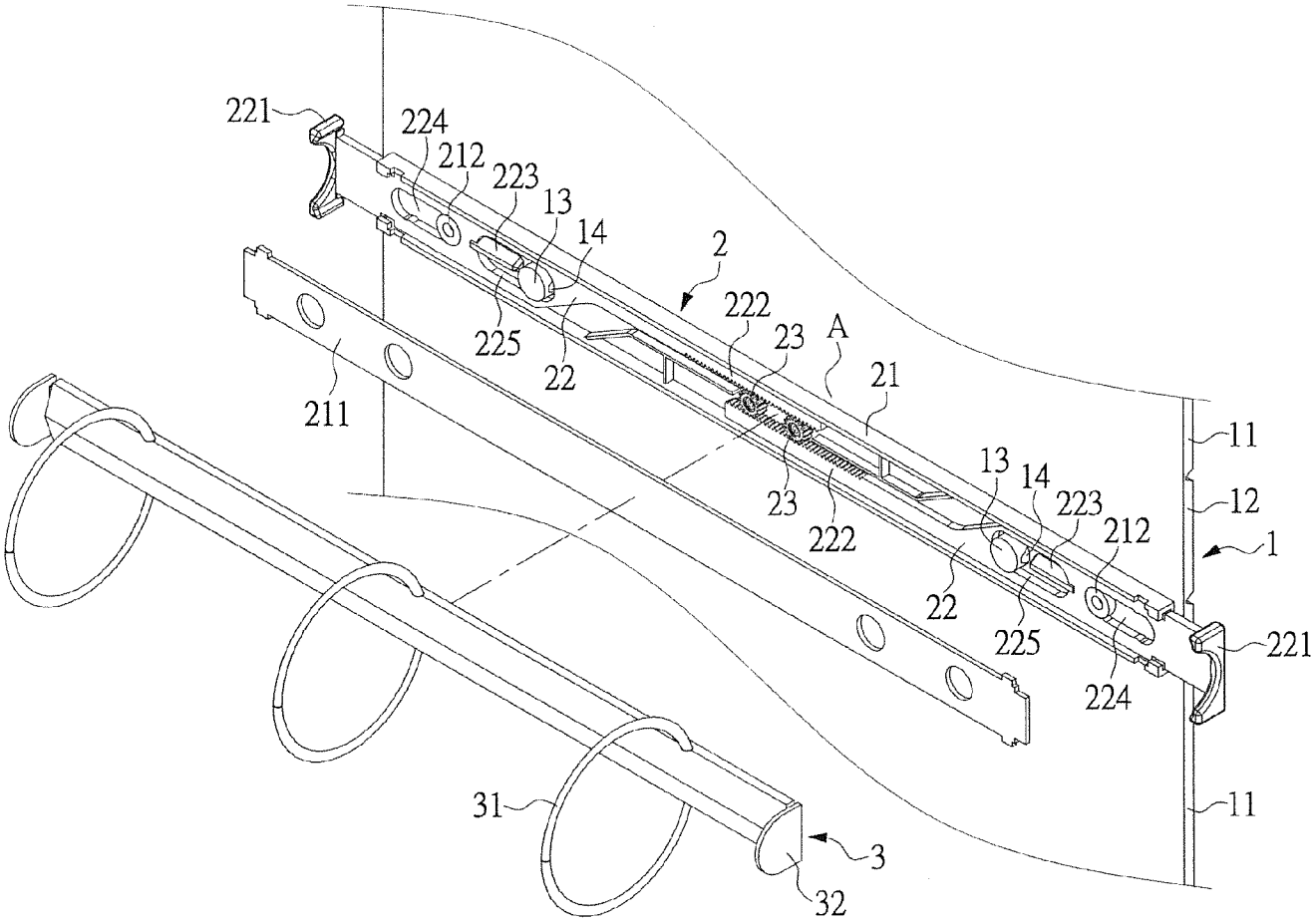
FIG. 1 is an exploded view of a document binder in accordance with the instant disclosure.

Please refer to FIGS. 1 to 4. The instant disclosure provides a document binder which includes a plate body 1, an engaging mechanism 2, and a fixture unit 3.

The plate body 1 is preferably made of plastic material, but is not limited herein. The plate body 1 for example can be made of polypropylene or similar materials. The plate body 1 can be integrally formed via injection molding or assembly but is not limited herein. The plate body 1 includes two side plates 11 and a bridging plate 12 connected between the side plates 11. The two side plates 11 can fold and unfold by flipping the bridging plate 12. On an inner surface of one of the side plates 11, a coupling portion A is formed thereon proximate to the bridging plate 12 for installing the engaging mechanism 2 and the fixture unit 3.

The coupling portion A has two protrusions 13 arranged thereon, the two protrusions 13 protrude out of the inner surface of the side plate 11. The shapes of the protrusions 13 are not limited only to circular or rectangular protrusions. The two protrusions 13 each has an engaging slot 14. The two engaging slots 14 are respectively recessed on two sidewalls of the protrusions 13. Each engaging slot 14 can be formed by punching through or not punching all the way through the protrusions 13. In other words, one engaging slot 14 can be recessed or punched all the way through on one sidewall of the protrusion 13. In the instant embodiment, the protrusions 13 are punched through along a radial direction at two sidewalls thereof to form the engaging slots 14.

The engaging mechanism 2 and the plate body 1 can be designed to be separable. The engaging mechanism 2 includes a rail 21, two slidable shafts 22, and at least one gear 23. The rail can be a hollowed body in order to receive the two slidable shafts 22 and the gear 23. The rail 21 is selectively disposed on the coupling portion A of the plate body 1. The rail 21 can further include a cover plate 211 covering the rail 21.

The two slidable shafts 22 are slidably disposed in the rail 21. The two slidable shafts 22 can be displaced along the longitudinal direction of the rail 21. An end of each of the two slidable shafts 22 has a pivotable portion 221 arranged thereon. The two pivotable portions 221 extend out of the rail 21 such that the two slidable shafts 22 can be driven by the pivotable portion 221 and displaced in the rail 21. Each of the two slidable shafts 22 has a gear strip 222 arranged thereon. The gear strip 222 can be integrally formed on the slidable shaft 22. The two slidable shafts 22 are configured to face each other and are spaced apart by a preferred distance.

The two slidable shafts 22 may further have a guiding slot 224 arranged thereon. The rail 21 has two guiding protrusions 212 arranged thereon. The two guiding protrusions 212 are coupled in the two guiding slots 224 for stably guiding displacements of the two slidable shafts 22. The two slidable shafts 22 may each have an opening 225 arranged thereon. The protrusions 13 are received by the openings 225 which can also stably guide the displacements of the two slidable shafts 22.

The gear 23 may have one, two or a plurality of gears. In the instant embodiment, there are two gears 23 pivotally disposed in the rail 21, and the other two gears 23 are engaged to the two gear strips 222 such that the slidable shafts 22 can be displaced relatively stable. The two gears 23 are configured between the two slidable shafts 22. Since circumferential portions of the two gears 23 are respectively engaged to the two gear strips 22, the two gear strips 222 and the gear 23 form a linked mechanism, such that displacements of the two slidable shafts 22 are linked. In other words, users only need to push either one of the pivotable portions 221 such that one of the slidable shafts 22 displaces, and in turn the other slidable shaft 22 displaces correspondingly via the linked mechanism formed by the two gear strips 222 and the gears 23.

Figure 2:
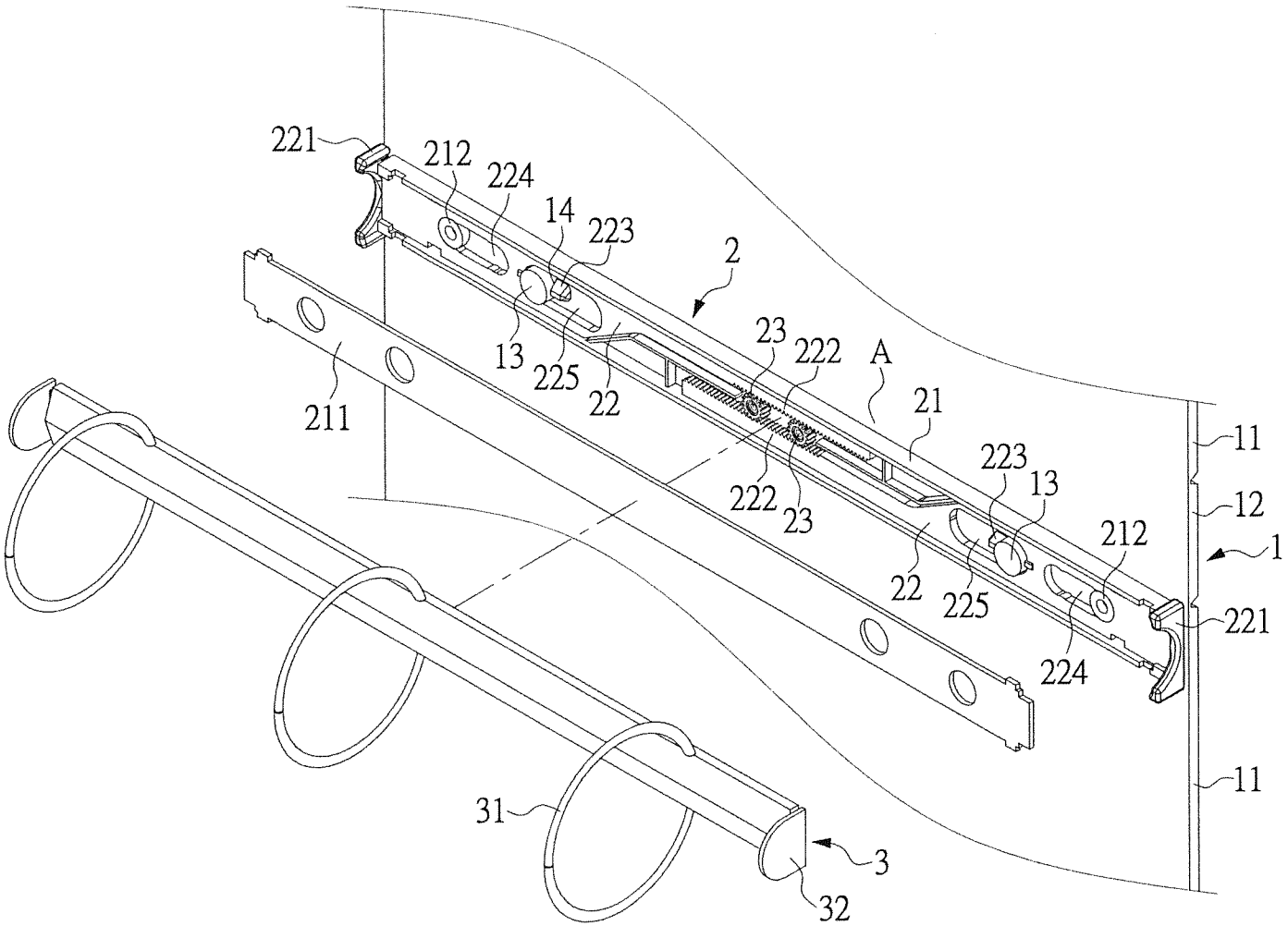
FIG. 2 is another exploded view illustrating another state of the document binder in accordance with the instant disclosure.
Figure 3:
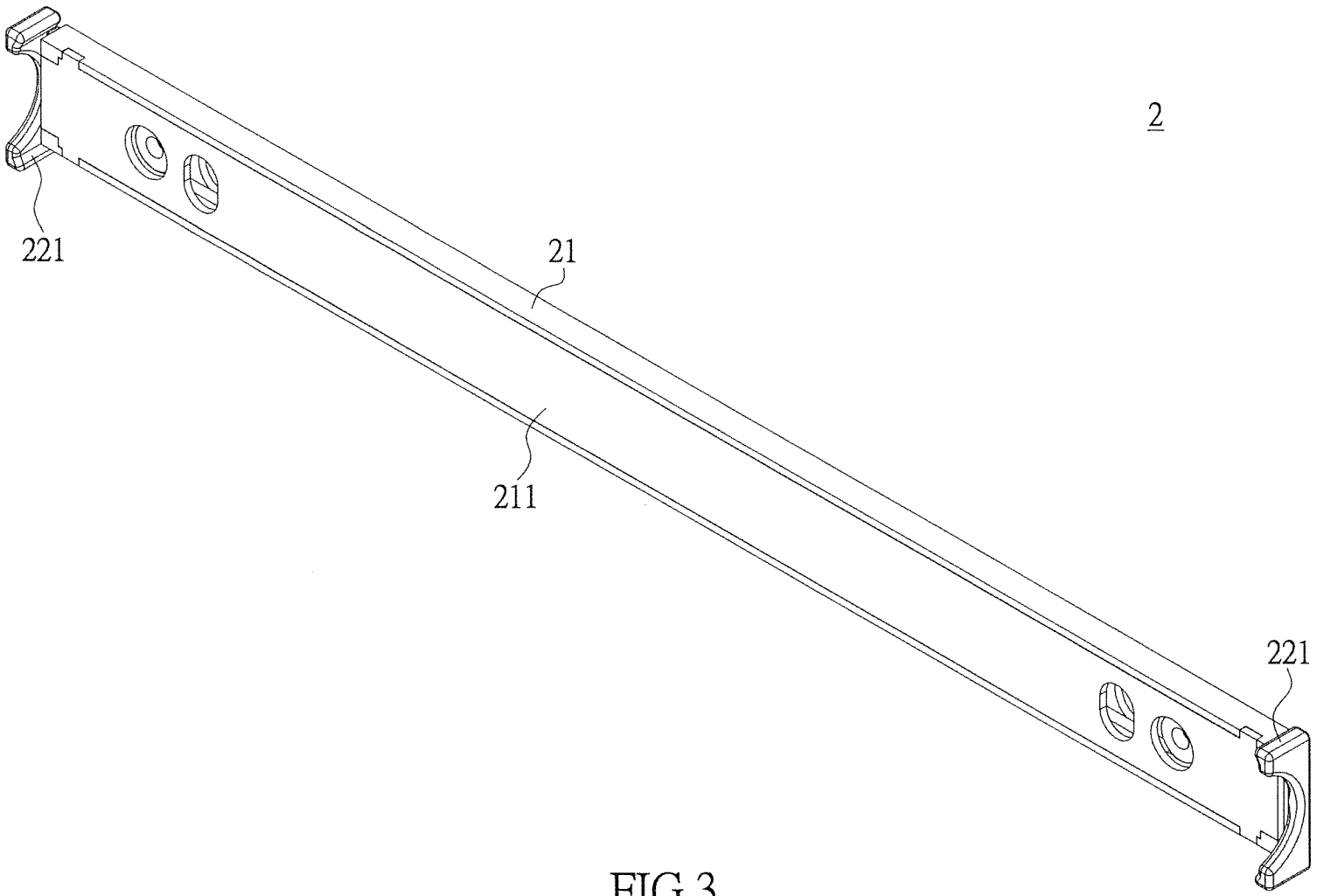
FIG. 3 is an assembled view illustrating an engaging mechanism of the document binder in accordance with the instant disclosure.
Figure 4:
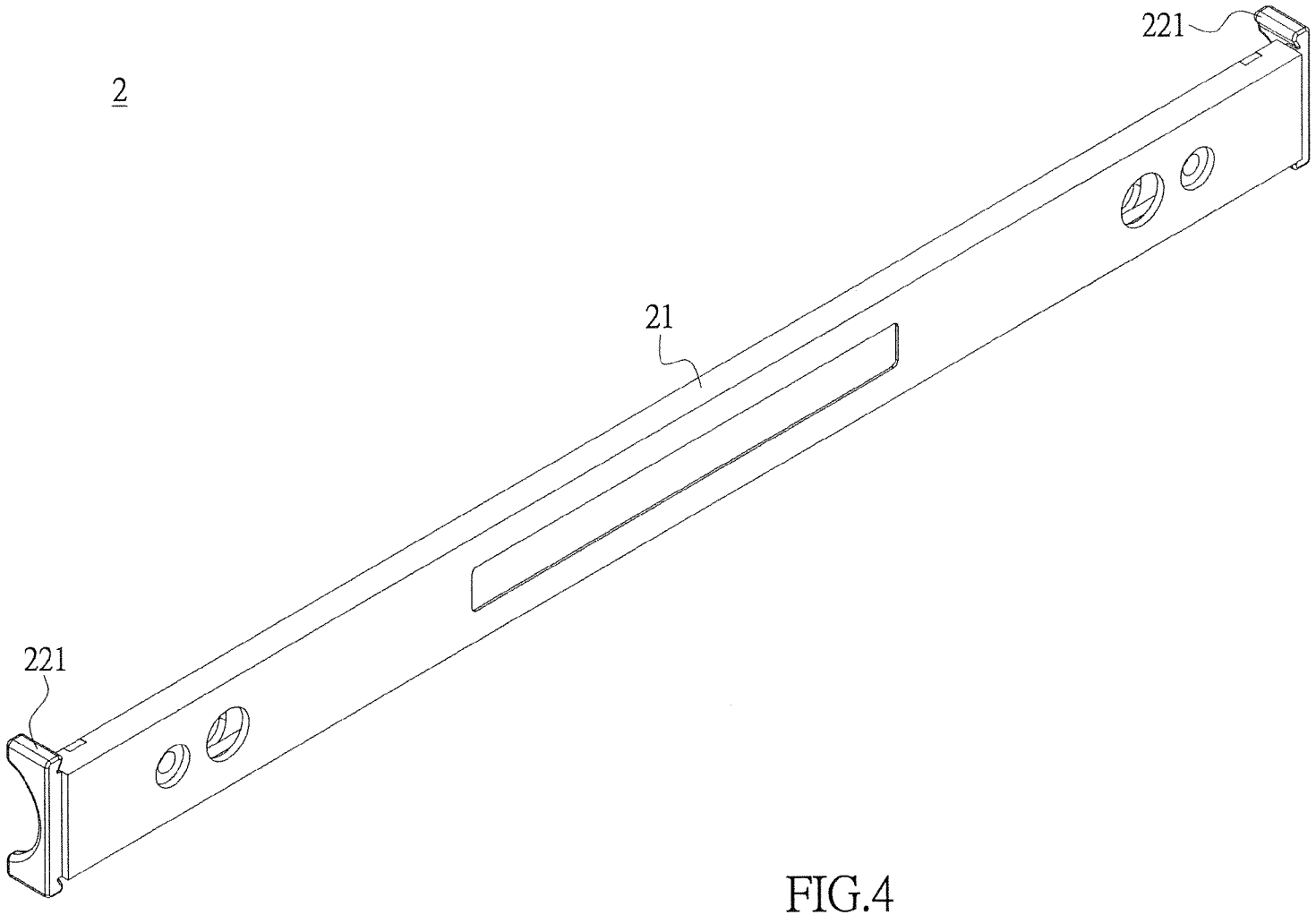
FIG. 4 is another assembled view illustrating the engaging mechanism of the document binder in accordance with the instant disclosure.

Each of the two slidable shafts 22 has an engaging body 223. The shape of the engaging body 223 corresponds to the shape of the engaging slot 14. The engaging body 223 is disposed on the slidable shaft 22 such that as the slidable shafts 22 simultaneously displace, the engaging bodies 223 of the two slidable shafts 22 selectively coupled to the engaging slots 14 of the protrusions 13. Specifically, the engaging bodies 223 of the two slidable shafts 22 can be inserted and wedged onto the engaging slot 14 of the two protrusions 13 (as shown in FIG. 2), such that the engaging structure 2 and the fixture unit 3 are stably fixed to the coupling portion A of the plate body 1. The engaging body 223 of the two slidable shafts 22 can also be removed from the engaging slots 14 of the protrusions 13 (as shown in FIG. 1), such that the engaging structure 2 and the fixture unit 3 can be separated from the coupling portion A of the plate body 1. At such time, the engaging structure 2 and the fixture unit 3 can be disassembled from the plate body 1 to facilitate hanging of documents in filing cabinets via the fixture unit 3 and without the use of the plate body 1.

The fixture unit 3 may have at least two retaining arms 31, but the number of retaining arms is not limited herein. The retaining arms 31 can be opened and closed via a pressable portion 32. The fixture unit 3 is not limited to the shape and sizes provided in the instant embodiment. The fixture unit 3 is fixed on the engaging structure 2. Moreover, the fixture unit 3 is fixed on the cover plate 211 of the engaging structure 2 in the instant embodiment, such that the fixture unit 3 can be fixed on the cover plate 211 of the engaging structure 2 via rivets or screws.

In the instant disclosure, the linked mechanism formed by gear strips 222 and gears 23 is configured between the two slidable shafts 22 of the engaging structure 2. Users only need to push one pivotable portion 221 such that one slidable shaft 22 displaces, and in turn the two slidable shafts 22 displace via the linked mechanism. As a result, the engaging bodies 223 of the two slidable shafts 22 can be engaged or disengaged to the engaging slots 14 of the two protrusions 13, and can assemble or disassemble the fixture unit 3 and plate body 1 with relatively simple and convenient operation.

Moreover, the engagement between the engaging bodies 223 of the two slidable shafts 22 and the engaging slots 14 of the two protrusions 13 facilitates the engaging structure 2 and the fixture unit 3 to be stably fixed onto the plate body 1 and lowers the chance of loosen or falling parts.

The figures and descriptions supra set forth illustrated the preferred embodiments of the instant disclosure; however, the characteristics of the instant disclosure are by no means restricted thereto. All changes, alternations, combinations or modifications conveniently considered by those skilled in the art are deemed to be encompassed within the scope of the instant disclosure delineated by the following claims.

What is claimed is:

1. A document binder, comprising:

a plate body including two side plates and a bridging plate connected between the two side plates, an inner surface of one of the side plates having a coupling portion arranged on the inner surface proximate to the bridging plate, the coupling portion having two protrusions disposed thereon, and each of the two protrusions respectively having portions defining an engaging slot thereon;

an engaging mechanism including a rail, two slidable shafts and at least one gear, the rail removably attached to the coupling portion of the plate body, the two slidable shafts slidably received by the rail, an end of each slidable shaft having a moving portion arranged thereon, the two moving portions extending out of the rail, each slidable shaft having a gear strip, the gear pivotally disposed on the rail, the gear and the two gear strips engaged to each other, each slidable shaft having an engaging body arranged thereon, and each engaging body of the slidable shaft selectively coupled to the engaging slot of the protrusion; and a fixture unit fixed to the engaging mechanism.

2. The document binder as recited in claim 1, wherein each engaging slot is recessed on a sidewall of the protrusion.

3. The document binder as recited in claim 1, wherein each engaging slot is formed by punching through a sidewall of the protrusion along a radial direction of the protrusion, and at least two sidewalls are punched through.

4. The document binder as recited in claim 1, wherein the plate body is integrally formed with plastic materials.

5. The document binder as recited in claim 1, wherein circumferential portions of the gear engage the two gear strips.

6. The document binder as recited in claim 1, wherein two gears are provided.

7. The document binder as recited in claim 1, wherein each of the two slidable shafts has a guiding slot arranged thereon, the rail has two guiding protrusions arranged thereon, and the two guiding protrusions respectively couple to two guiding slots.

8. The document binder as recited in claim 1, wherein each of the two slidable shafts has portions defining an opening thereon, and the two protrusions respectively couple to the two openings.

9. The document binder as recited in claim 1, wherein the rail is covered by a cover plate and the fixture unit is fixed on the cover plate.

* * * * *